US005547185A

United States Patent [19]

Wagner et al.

[11] Patent Number: 5,547,185

[45] Date of Patent: Aug. 20, 1996

[54] ADJUSTABLE BASKETBALL GOAL

[76] Inventors: Glenn Wagner; Anita Wagner, both of 516 N. Hudson, Tulsa, Okla. 74115

[21] Appl. No.: 548,089

[22] Filed: Oct. 25, 1995

[51] Int. Cl.[6] ..... A63B 63/08

[52] U.S. Cl. ..... 273/1.5 R; 248/295.11; 254/387

[58] Field of Search ..... 273/1.5 R, 1.5 A; 248/295.11, 297.11, 297.31, 297.51; 254/387

[56] References Cited

U.S. PATENT DOCUMENTS

| | | | |
|---|---|---|---|
| 1,076,588 | 10/1913 | Lemirand | 248/297.31 |
| 1,078,998 | 11/1913 | Ernst | 254/387 X |
| 2,180,042 | 11/1939 | Ettinger | 248/132 X |
| 2,364,155 | 12/1944 | Martineau | 248/295.11 X |
| 3,158,354 | 11/1964 | Ward | 254/387 X |
| 3,329,427 | 7/1967 | Bearson | 273/1.5 R |
| 4,508,337 | 4/1985 | Gillespie, Jr. | 273/1.5 R |
| 4,798,381 | 1/1989 | Dadbeh | 273/1.5 R |
| 4,846,470 | 7/1989 | Peterson | 273/1.5 R |
| 5,102,128 | 4/1992 | Geise | 273/1.5 R |
| 5,156,395 | 10/1992 | Smith | 273/1.5 R |
| 5,292,118 | 3/1994 | Allen et al. | 273/1.5 R |
| 5,299,800 | 4/1994 | Daniels | 273/1.5 R |

*Primary Examiner*—Paul E. Shapiro
*Attorney, Agent, or Firm*—Joseph N. Breaux

[57] ABSTRACT

A basketball goal and pole is provided of the type permitting the height of the basketball goal above a playing surface to be adjusted. The adjustable basketball goal comprises: a vertical pole having a plurality of rails formed on the outside thereof running along the longitudinal axis of the pole, a crank assembly having a rotatable reel fastened to the pole beneath the rails, a pulley assembly having a grooved wheel fastened to the pole atop the rails, a collar having an interior surface forming trackways slidably mounted on the rails and movable between the crank assembly and the pulley assembly, a basketball goal extending upwardly and outwardly from the collar, and a cable connected to the reel and threaded over the grooved wheel and connected to the collar for moving the collar between the crank assembly and the pulley assembly.

7 Claims, 1 Drawing Sheet

FIG. 1
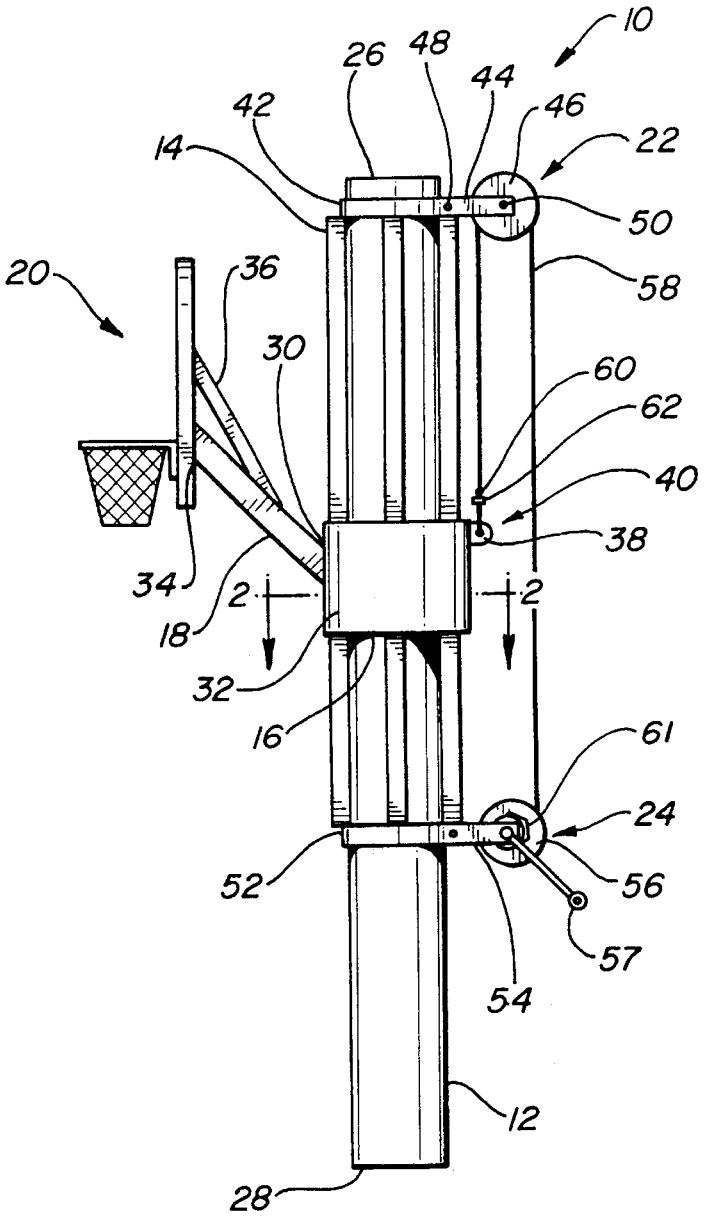
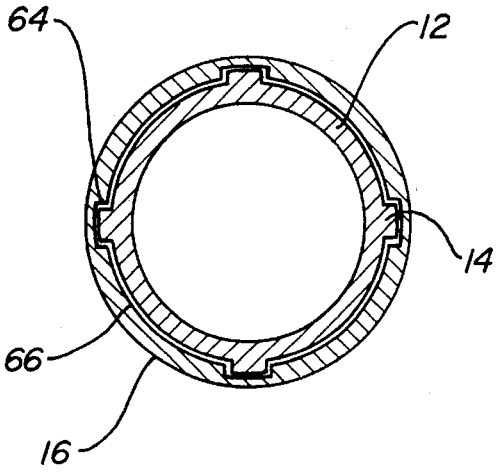
FIG. 2

ADJUSTABLE BASKETBALL GOAL

TECHNICAL FIELD

The present invention relates to sporting devices and more particularly to an adjustable basketball goal.

BACKGROUND ART

Basketball is a popular sport which is played by people of all ages in organized leagues and in pick-up games. The standard basketball goal is erected ten feet above a basketball playing surface, often making it difficult for younger players to enjoy the game. It is also desirable at times for older and better players to have a lower basketball goal for slam dunk contests. However, once a standard basketball goal is erected the height of the goal cannot be adjusted. There are several prior art adjustable height basketball goals, however, these prior art devices are expensive, difficult to operate, cumbersome, and difficult and expensive to repair.

It would be a benefit, therefore, to have an adjustable basketball goal which is inexpensive so that it may be purchased for home use or by schools. It would be a further benefit to have an adjustable basketball goal that is easy to erect and operate. It would be a still further benefit to have an adjustable basketball goal that provides a stable basketball goal. It would be a still further benefit to have an adjustable basketball goal that is easy and inexpensive to repair.

GENERAL SUMMARY DISCUSSION OF INVENTION

It is thus an object of the invention to provide a adjustable basketball goal that has a basketball goal connected to a collar having interior trackways slidably mounted on a pole having a plurality of longitudinal rails thereon.

It is a further object of the invention to provide a adjustable basketball goal that is easy to erect and operate.

It is a still further object of the invention to provide a adjustable basketball goal that is inexpensive and easy to repair.

Accordingly, a basketball goal and pole is provided of the type permitting the height of the basketball goal to be adjusted above a playing surface. The adjustable basketball goal comprises: a vertical pole having a plurality of rails formed on the outside thereof running along the longitudinal axis of the pole, a crank assembly having a rotatable reel fastened to the pole beneath the rails, a pulley assembly having a grooved wheel fastened to the pole atop the rails, a collar having an interior surface forming trackways slidably mounted on the rails and movable between the crank assembly and the pulley assembly, a basketball goal extending upwardly and outwardly from the collar, and a cable connected to the reel and threaded over the grooved wheel and connected to the collar for moving the collar between the crank assembly and the pulley assembly.

The pole is formed of circular steel tubing having a top and bottom end. The rails are formed parallel to one another on the outside of pole along the pole's longitudinal axis. A plurality of rails run from substantially the top end of the pole to about the median point of pole. Preferably, four rails are spaced at even intervals to prevent the goal from rotating while a game of basketball is being played. The rails may be beveled to aid in moving the collar along the rails.

The bottom end of the pole may be adapted for placement in the ground extending the pole vertically above a playing surface. A base member may be connected to the bottom end of the pole for supporting the pole vertically above a playing surface.

The collar is constructed of metal and has an interior surface forming trackways for slidably mounting the collar on the rail portion of the pole. The trackways may be contoured to match the rails to prevent the collar from binding when being raised or lowered. The basketball goal is extended upwardly and outwardly by a beam connected between the collar and the basketball goal. A cross beam may be connected between the beam and the basketball goal for providing extra support.

The crank assembly may be any crank assembly well known in the art. The crank assembly may be hand operated or motorized. The crank assembly has a reel for spooling the cable thereon. The first end of the cable is attached to the reel and threaded over the grooved wheel of the pulley assembly attached to the pole atop the rails. The second end of the cable is attached to the collar for moving the collar between the crank and pulley assemblies, thus, adjusting the height of the basketball goal above the playing surface. The cable may have an outer plastic casing reducing the friction while adjusting the height of the basketball goal.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein:

FIG. 1 is a side view of an exemplary embodiment of the adjustable basketball goal of the present invention.

FIG. 2 is a cross-sectional, top view of the collar and pole in isolation taken along the line 2—2 shown in FIG. 1.

EXEMPLARY MODE FOR CARRYING OUT THE INVENTION

FIG. 1 is a side view of an exemplary embodiment of the adjustable basketball goal of the present invention generally designated by the numeral 10. Adjustable basketball goal 10 includes a pole 12, rails 14, a collar 16, a beam 18, a conventional basketball goal 20, a pulley assembly 22 and a crank assembly Pole 12 is formed of circular steel tubing having a top and bottom end 26,28. Rails 14 are formed parallel to one another on the outside of pole 12 along its longitudinal axis. Rails 14 run from substantially the top end 26 of pole 12 to about the median point of pole 12. Bottom end 28 of pole 12 is adapted for placement in the ground extending pole 12 vertically above a playing surface.

Collar 16 is constructed of metal and is slidably mounted on the rail portion of pole 12. Beam 18 extends upwardly and outwardly from a lower end 30 connected to the outer surface 32 of collar 16 by welding to an upper end 34 connected to basketball goal 20 by bolting (not shown). A cross beam 36 is rigidly connected between beam 18 and basketball goal 20. A metal tab 38 forming an eyelet 40 therethrough is welded to outer surface 32 of collar 16 opposite the connection of beam 18.

Pulley assembly 22 includes a first circular clamp 42 having depending arms 44 and a grooved wheel 46. First clamp 42 is securely fastened about pole 12 atop rails 14 by a nut and bolt connection 48. Grooved wheel 46 is rotatably connected between depending arms 44 by a pivot pin 50.

Crank assembly 24 is a conventional crank assembly well known in the art including a second circular clamp 52 having depending arms 54, a reel 56, a handle 58, and a locking mechanism 60. Second clamp 52 is securely fastened about pole 12 beneath rails 14 by a nut and bolt connection 48. Reel 56 is rotatably connected between depending arms 54 by handle 56, handle 56 being in operational connection with reel 56. Locking mechanism 60 is selectively engagable with reel 56.

A cable 58 having a first end (not shown) and a second end 60 is connected between reel 56 and collar 16 for moving collar 16 between pulley assembly 22 and crank assembly 24. The first end of cable 58 is securely attached to reel 56 and threaded over grooved wheel 46 and second end 60 is connected to collar 32. Second end 32 is secured to collar 32 by passing second end 32 through eyelet 40 and securing with a saddle clamp 62.

FIG. 2 is a cross-sectional, top view of collar 16 and pole 12 in isolation taken along the line 2—2 shown in FIG. 1. As shown, collar 16 defines four trackways 64 evenly spaced along its interior surface 66. Collar 16 is slidably mounted on pole 12 with rails 14 slidably disposed within trackways 64. Rails 14 are beveled and trackways 64 are companionately contoured to resist binding when raising or lowering basketball goal 20 in relation to pole 12 as shown in FIG. 1.

Use of the adjustable basketball goal is now described with reference to FIGS. 1 and 2. Bottom end 28 of pole 12 is secured in the playing surface (not shown) so that pole 12 extends perpendicularly to the playing surface with basketball goal 20 extending above the playing surface. To raise basketball goal 20 above the playing surface the user disengages locking mechanism 60 and then turns handle 58 clockwise spooling cable 58 onto reel 56 urging collar 16 towards top end 26 of pole 12 until reaching the desired height and then reengaging locking mechanism 60 locking goal 20 at the selected height. To lower basketball goal 20 the above process is reversed.

It can be seen from the preceding description that a sporting device which has a basketball goal slidably mounted on a pole having a plurality of longitudinal rails thereon, is easy to erect and operate, and is inexpensive and easy to repair has been provided.

It is noted that the embodiment of the adjustable basketball goal described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A adjustable basketball goal comprising:

a vertical pole disposed to extend above a playing surface, said pole having a plurality of rails formed on an outside thereof running along the longitudinal axis of said pole;

a crank assembly having a rotatable reel fastened to said pole beneath said rails;

a pulley assembly having a grooved wheel fastened to said pole atop said rails;

a collar having an interior surface forming trackways therein, said collar being slidably mounted on said pole, said rails being disposed within said trackways, said collar being movable between said crank assembly and said pulley assembly;

a basketball goal extending upwardly and outwardly from said collar; and a cable having a first end connected to said reel and a second end connected to said collar, said cable being threaded over said grooved wheel for moving said collar between said crank assembly and said pulley assembly.

2. The adjustable basketball goal of claim 1, further including:

a locking mechanism in connection with said crank assembly for maintaining said basketball goal at a selected height.

3. The adjustable basketball goal of claim 1, wherein:

said rails have beveled edges.

4. The adjustable basketball goal of claim 3, wherein:

said trackways formed by said interior surface of said collar are contoured to slidably dispose said rails.

5. The adjustable basketball goal of claim 4, wherein:

a locking mechanism in connection with said crank assembly for maintaining said basketball goal at a selected height.

6. The adjustable basketball goal of claim 1, wherein:

said trackways formed by said interior surface of said collar are contoured to slidably dispose said rails.

7. A adjustable basketball goal comprising:

a vertical pole disposed to extend above a playing surface, said pole having a plurality of rails formed on an outside thereof running along the longitudinal axis of said pole, said rails having beveled edges;

a crank assembly having a rotatable reel fastened to said pole beneath said rails;

a locking mechanism in connection with said crank assembly for maintaining said basketball goal at a selected height;

a pulley assembly having a grooved wheel fastened to said pole atop said rails;

a collar having an interior surface forming trackways contoured for slidably disposing said rails therein, said collar being slidably mounted on said pole, said rails being disposed within said trackways, said collar being movable between said crank assembly and said pulley assembly;

a basketball goal extending upwardly and outwardly from said collar; and a cable having a first end connected to said reel and a second end connected to said collar, said cable being threaded over said grooved wheel for moving said collar between said crank assembly and said pulley assembly.

* * * * *